US008677517B1

(12) United States Patent
Morency et al.

(10) Patent No.: US 8,677,517 B1
(45) Date of Patent: Mar. 25, 2014

(54) VISOR SYSTEM FOR HELMET

(75) Inventors: Stéphane Morency, Montreal (CA); Pierre Vallée, Quebec (CA); Stéphane Lebel, St.-Rédempteur (CA); Dominique Croteau, Montreal (CA)

(73) Assignee: Revision Military Inc., Montreal (CA)

( * ) Notice: Subject to any disclaimer, the term of this patent is extended or adjusted under 35 U.S.C. 154(b) by 1108 days.

(21) Appl. No.: 11/811,361

(22) Filed: Jun. 9, 2007

Related U.S. Application Data

(60) Provisional application No. 60/812,434, filed on Jun. 9, 2006.

(51) Int. Cl.
*A42B 1/08* (2006.01)

(52) U.S. Cl.
USPC ..... 2/424; 2/15; 2/422

(58) Field of Classification Search
USPC ..... 2/422, 424, 5, 6.1, 6.2, 6.3, 6.5, 6.6, 2/6.7, 8.2, 15, 10, 9; 351/57, 59; 24/457, 24/560
See application file for complete search history.

(56) References Cited

U.S. PATENT DOCUMENTS

| | | | | | |
|---|---|---|---|---|---|
| 2,648,843 | A | | 8/1953 | Hirschmann | |
| 3,147,487 | A | | 9/1964 | Hoeftman | |
| 3,594,816 | A | * | 7/1971 | Webb et al. | 2/10 |
| D228,700 | S | | 10/1973 | Gager | |
| 3,797,042 | A | * | 3/1974 | Gager, Jr. | 2/10 |
| 3,945,043 | A | | 3/1976 | DeAngelis | |
| 4,028,743 | A | | 6/1977 | Christensen | |
| 4,055,874 | A | * | 11/1977 | Brown | 24/67.3 |
| 4,136,403 | A | * | 1/1979 | Walther et al. | 2/10 |
| 4,170,042 | A | | 10/1979 | Aileo | |
| 4,170,792 | A | | 10/1979 | Higgs | |
| 4,536,892 | A | | 8/1985 | Brinkhoff et al. | |
| 4,615,052 | A | | 10/1986 | Nava | |
| 4,675,920 | A | | 6/1987 | Glasheen | |
| D291,127 | S | | 7/1987 | Bohjort | |
| 4,713,844 | A | * | 12/1987 | Westgate | 2/411 |
| 4,755,023 | A | | 7/1988 | Evans et al. | |
| 4,847,920 | A | | 7/1989 | Aileo et al. | |
| 4,901,374 | A | | 2/1990 | Van der Woude | |
| 4,924,526 | A | | 5/1990 | Parissenti et al. | |
| 4,993,081 | A | | 2/1991 | Fulghum | |
| 5,012,528 | A | | 5/1991 | Pernicka et al. | |
| 5,131,101 | A | | 7/1992 | Chin | |
| D331,645 | S | | 12/1992 | Gallet | |
| 5,177,816 | A | | 1/1993 | Schmidt | |

(Continued)

*Primary Examiner* — Khoa Huynh
*Assistant Examiner* — Andrew W Collins
(74) *Attorney, Agent, or Firm* — Wolf, Greenfield & Sacks, P.C.

(57) ABSTRACT

A visor mounting apparatus for mounting a face shield to a helmet includes end portions mounted to the helmet and connecting ends of the shield to the helmet and a front attachment between the helmet and the shield comprising a mounting portion for attaching to the shield and an engagement portion having a tapered slot configured for clasping a brim of the helmet. In another embodiment the front attachment is a gasket that extends for the entire width of the shield and seals against liquid entering between the shield and the helmet. The face shield can have a varying thickness profile to correct for optical aberrations, the thickness profile taken from a center toward one lateral end that has a first region that sinusoidally decreases, and then an adjacent second region that sinusoidally increases to a third region adjacent the second region that sinusoidally decreases.

20 Claims, 15 Drawing Sheets

(56) References Cited

U.S. PATENT DOCUMENTS

| | | | | |
|---|---|---|---|---|
| 5,245,709 | A | 9/1993 | Shipcott | |
| 5,247,706 | A | 9/1993 | Mark | |
| 5,329,642 | A | 7/1994 | Dampney | |
| D352,726 | S | 11/1994 | Bolle | |
| 5,396,661 | A | 3/1995 | Sutter et al. | |
| 5,469,229 | A | 11/1995 | Greenbaum | |
| 5,526,183 | A | 6/1996 | Chen | |
| D373,223 | S | 8/1996 | Pernicka et al. | |
| D382,672 | S | 8/1997 | Bourque | |
| 5,689,833 | A | 11/1997 | Allen et al. | |
| 5,692,522 | A | 12/1997 | Landis | |
| D406,402 | S | 3/1999 | Simpson | |
| D406,404 | S | 3/1999 | Simpson | |
| 5,901,369 | A | 5/1999 | Pilney | |
| 5,966,738 | A | 10/1999 | Wang Lee | |
| 5,987,652 | A * | 11/1999 | Fowler | 2/424 |
| 6,029,269 | A | 2/2000 | El-Soudani | |
| D429,751 | S | 8/2000 | Garrity | |
| 6,161,225 | A | 12/2000 | Arai | |
| 6,178,561 | B1 | 1/2001 | Cheng | |
| 6,247,205 | B1 * | 6/2001 | Damadian et al. | 24/3.12 |
| D454,667 | S | 3/2002 | Chartrand | |
| 6,381,750 | B1 * | 5/2002 | Mangan | 2/10 |
| D481,173 | S | 10/2003 | Alexander et al. | |
| 6,701,537 | B1 * | 3/2004 | Stamp | 2/424 |
| 6,795,977 | B2 | 9/2004 | Basson et al. | |
| 6,820,285 | B2 | 11/2004 | Bataille | |
| 6,892,393 | B1 * | 5/2005 | Provost et al. | 2/10 |
| 7,003,802 | B2 | 2/2006 | Broersma | |
| D567,450 | S | 4/2008 | Renfrew | |

* cited by examiner

VISOR SYSTEM FOR HELMET

This application claims the benefit of U.S. Provisional Application Ser. No. 60/812,434 filed Jun. 9, 2006.

TECHNICAL FIELD OF THE INVENTION

The present invention relates to visors for use with helmets, and particularly for impact resistant visors for use in military helmets and in law-enforcement helmets.

BACKGROUND OF THE INVENTION

Visors for use in military and law-enforcement helmets are known such as disclosed in U.S. Pat. Nos. 5,901,369 and 4,536,892. These visors provide pivot arrangements on opposite lateral sides of the visor to allow the visor to be pivoted upward away from the user's face when the visor is not deployed. The visor is held in a deployed position in front of the user's face by locking of the pivot arrangements. During use, there is a space or gap located between a top edge of the visor and the helmet brim or front edge.

The present inventors have recognized that the gap located between a top edge of the visor and the helmet front edge make the visor arrangement susceptible to a shaking, up-and-down movement, despite the fixation at opposite lateral edges of the visor assembly. Furthermore, the present inventors have recognized this gap provides an entryway for liquids projected at the user, such as flammable liquids thrown by persons in a rioting mob or by other adversaries.

The present inventors have also recognized that the optical properties of cylindrical visors can be improved with a preselected thickness profile around a perimeter of the visor.

SUMMARY OF THE INVENTION

The invention provides improved visor systems for helmets. According to a first embodiment a visor is attached to opposite lateral sides of the helmet in a conventional fashion. A center stop fixture is clamped to a top edge of the visor. The center stop spans a gap that exists between the top edge of the visor and the bottom adjacent edge or lip of the helmet. The center stop fixture includes an angled notch or slot that engages the lip of the helmet. The center stop fixture prevents up or down movement or vibration of the visor with respect to the helmet. In this regard the center stop fixture acts as an attachment and as a shock absorbing or damping element.

The center stop fixture includes a body composed of a thermoplastic elastomer that is molded over a resilient metal clip. The resilient clip defines a slot that receives in clamping fashion a top edge portion of the visor, particularly to a transparent face shield of the visor.

According to an alternate embodiment, the center stop fixture is replaced by a gasket that extends laterally to close the gap between the top edge of the visor and the helmet lip. The gasket is clamped over the top edge of the visor and includes a notch or slot that engages the helmet lip in a sealing fashion.

The gasket includes a body composed of a thermoplastic elastomer that is molded over one or more resilient metal clips. The resilient clips define a slot that receives in clamping fashion a top edge portion of the visor, particularly to a transparent face shield of the visor.

The gasket prevents penetration of harmful liquids thrown from outside the visor to an inside of the visor and thus prevents contact with the wearer's eyes. Both the center stop fixture and the gasket can be provided with the visor for selectable use by the wearer. The center stop fixture provides more air circulation behind the visor given the presence of the gap, while the gasket provides more protection from propelled liquids.

As a further aspect of the invention, the visor face shield has a unique thickness profile that provides an improved optical quality to the visor face shield despite the advantageous thickness of the visor face shield for ballistic protection. The thickness profile of the cylindrically curved visor face shield, for each side, includes a thick center, sinusoidally decreasing middle region and a sinusoidally increasing then decreasing end region.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
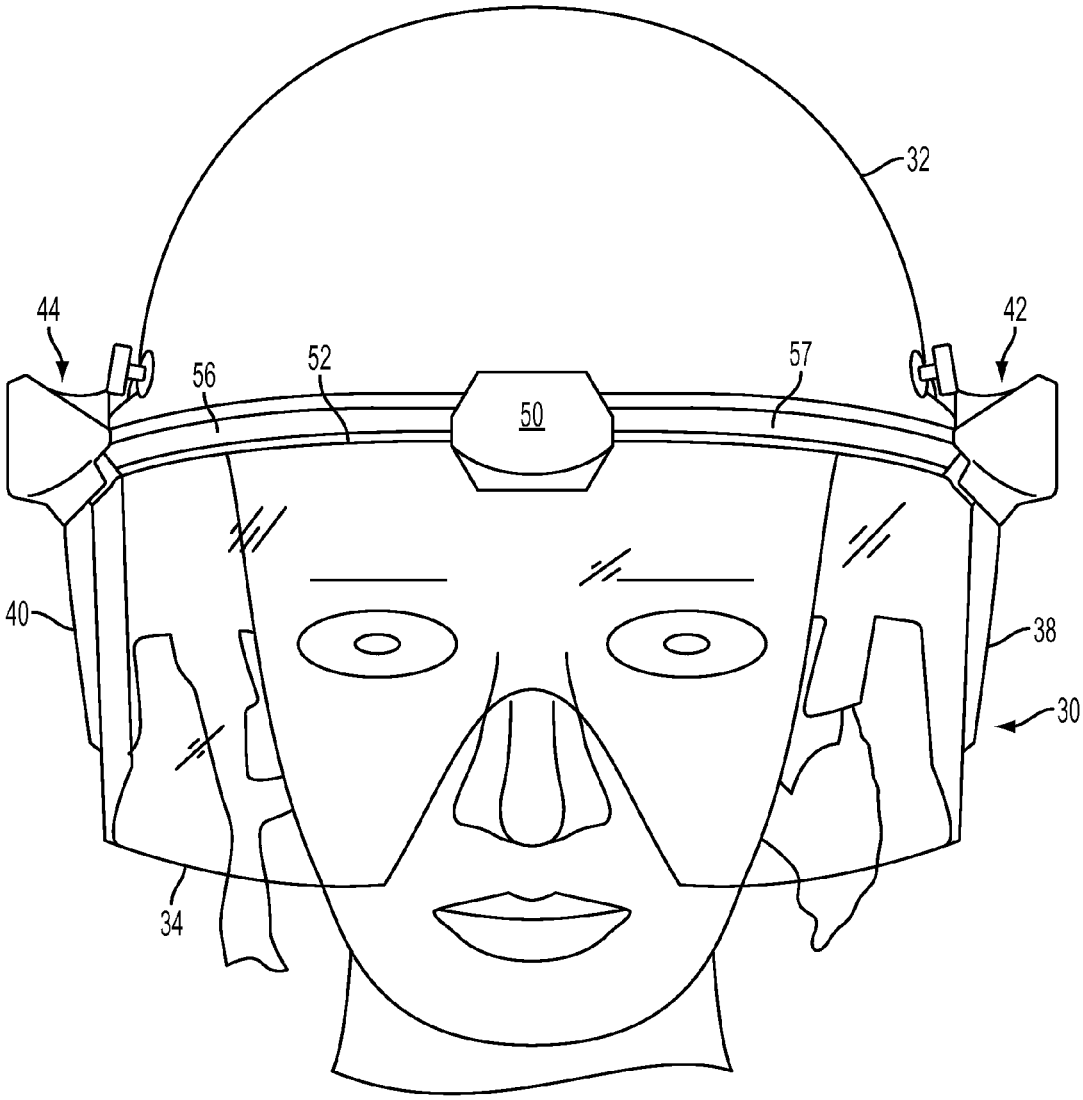
FIG. 1 is a front view of a visor system attached to a helmet in accordance with the present invention.
Figure 2:
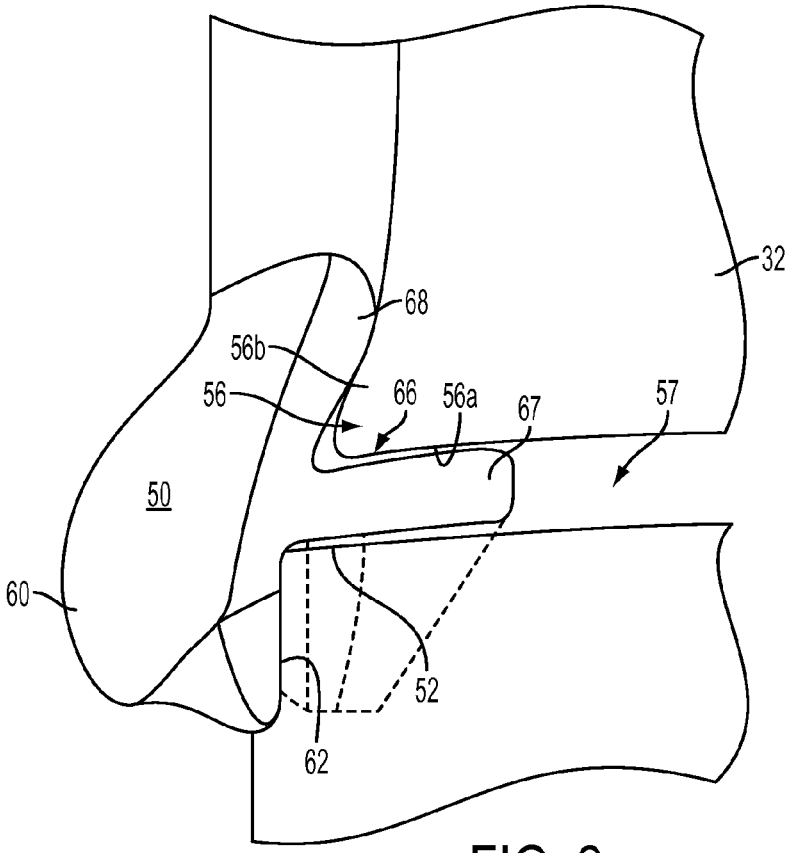
FIG. 2 is an enlarged, fragmentary, perspective view of a top edge visor stop taken from FIG. 1.
Figure 3:
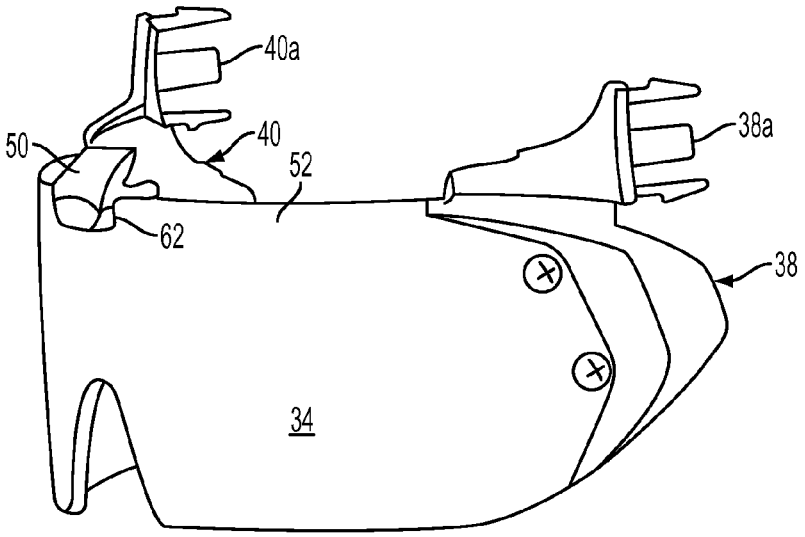
FIG. 3 is a front perspective view of the visor system of FIG. 1.
Figure 4:
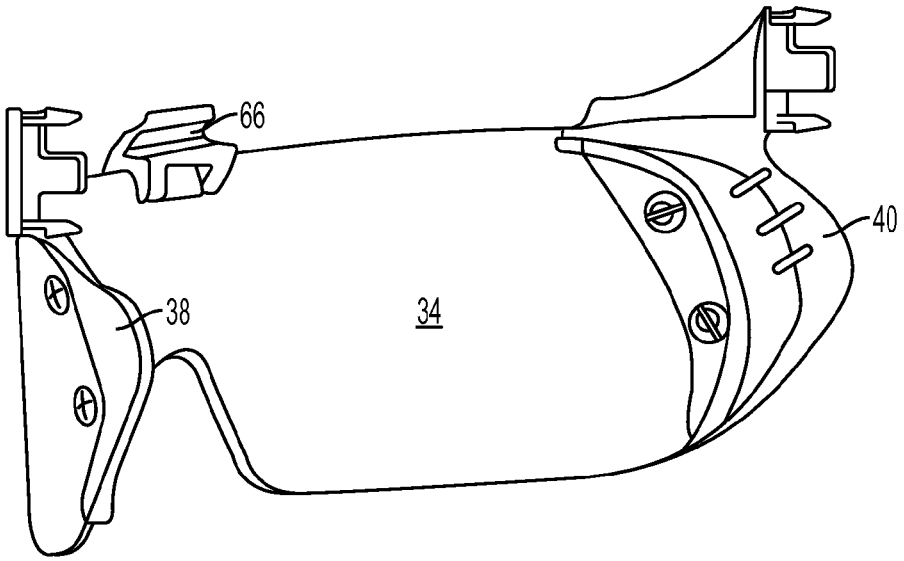
FIG. 4 is a rear perspective view of the visor system of FIG. 1.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 7:
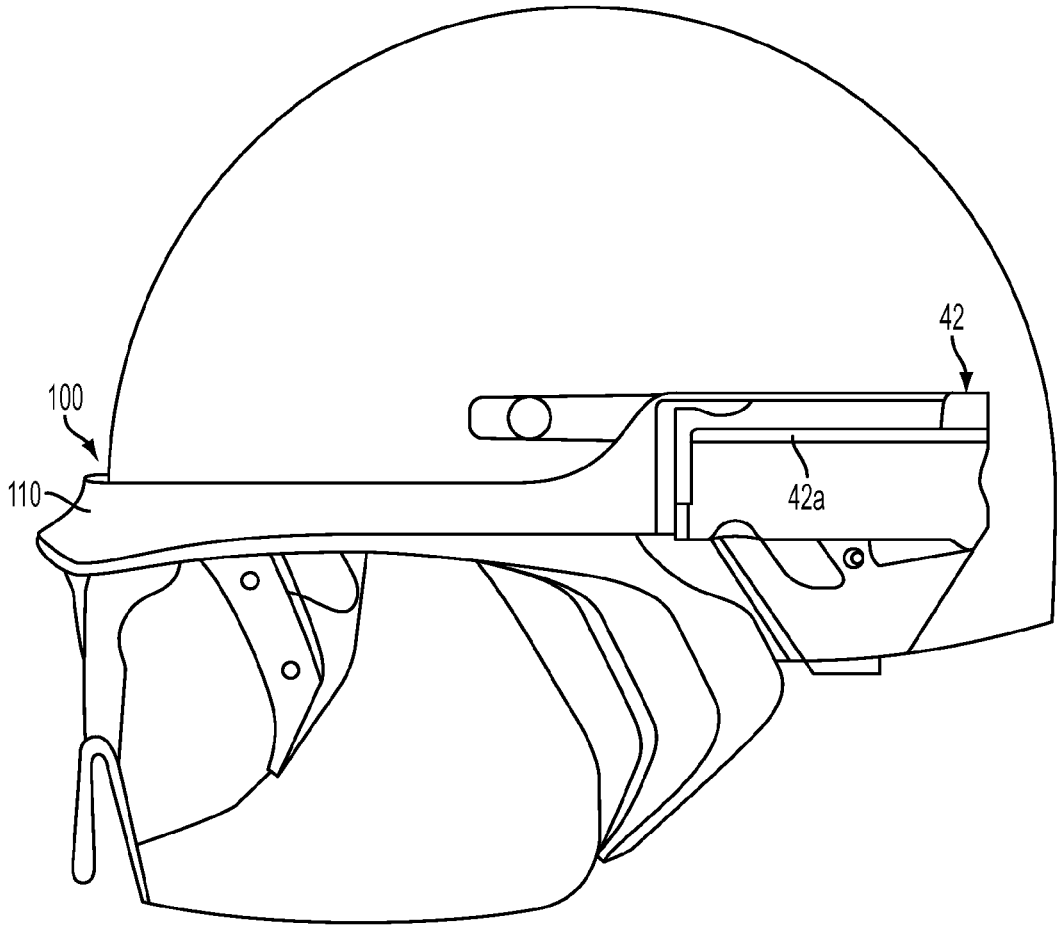
FIG. 7 is a perspective view of an alternate visor system attached to a helmet in accordance with the present invention.
Figure 8:
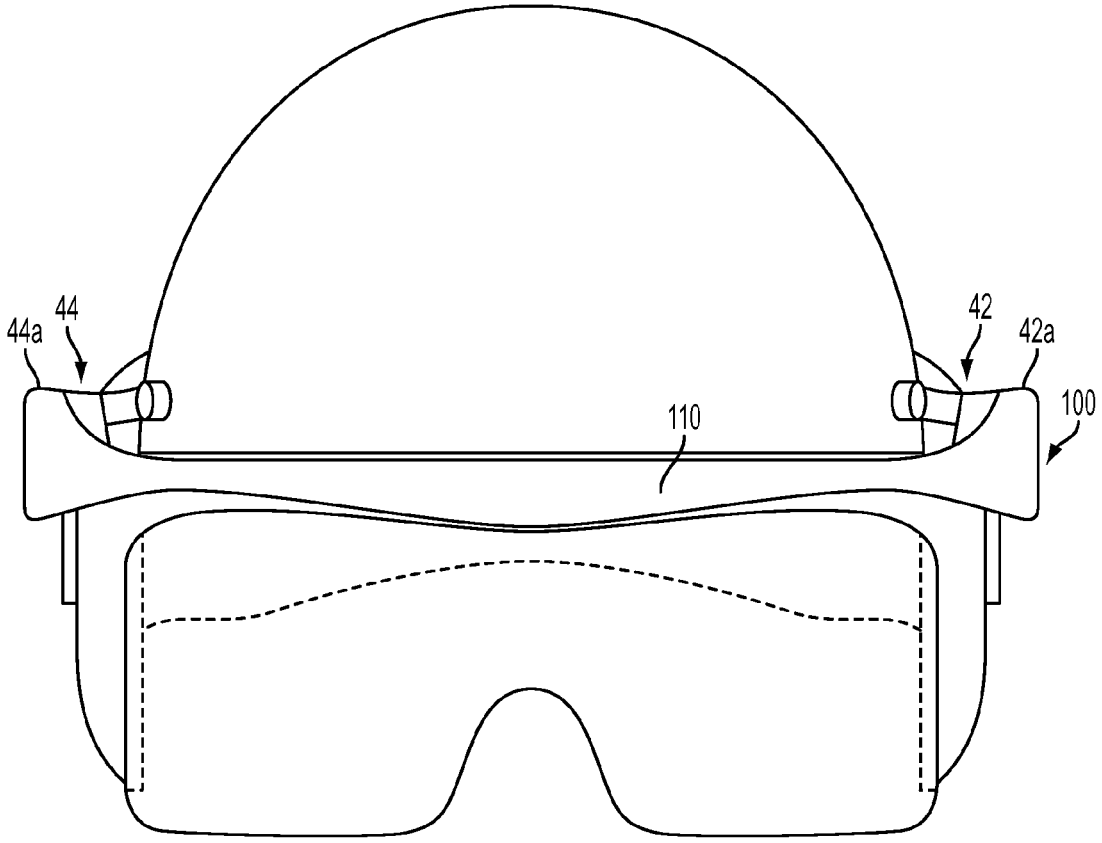
FIG. 8 is a front view of the alternate visor system shown in FIG. 7.
Figure 9:
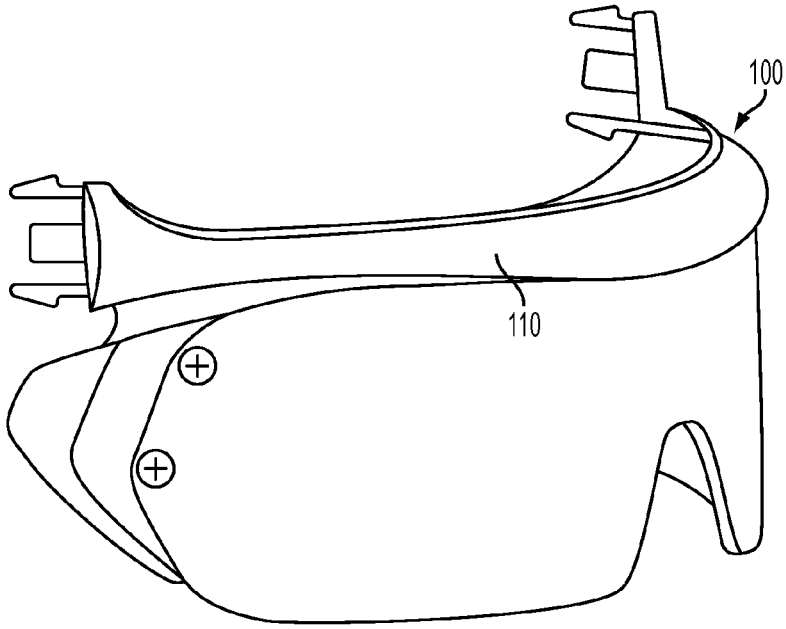
FIG. 9 is a front perspective view of the alternate visor system of FIG. 7.
Figure 10:
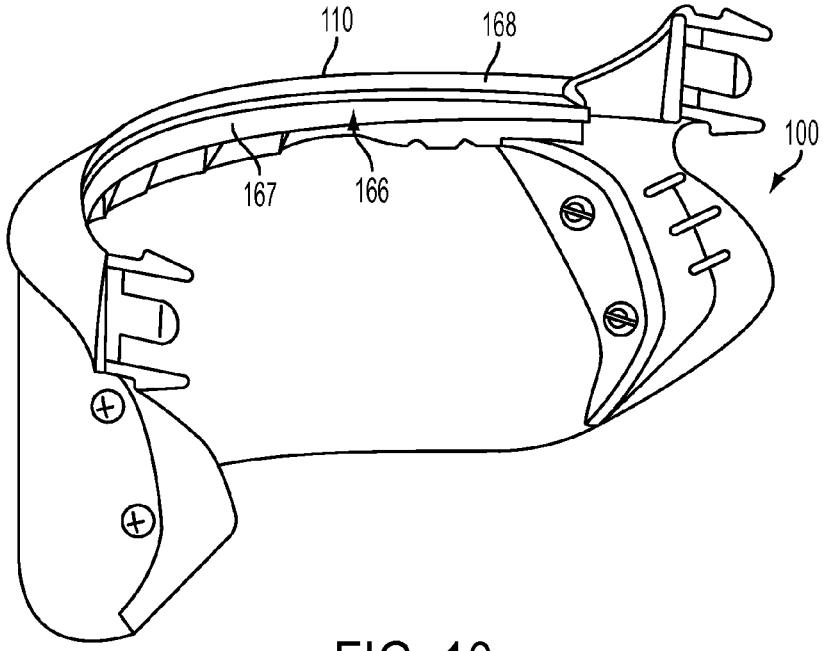
FIG. 10 is a rear perspective view of the alternate visor system of FIG. 7.
Figure 11:
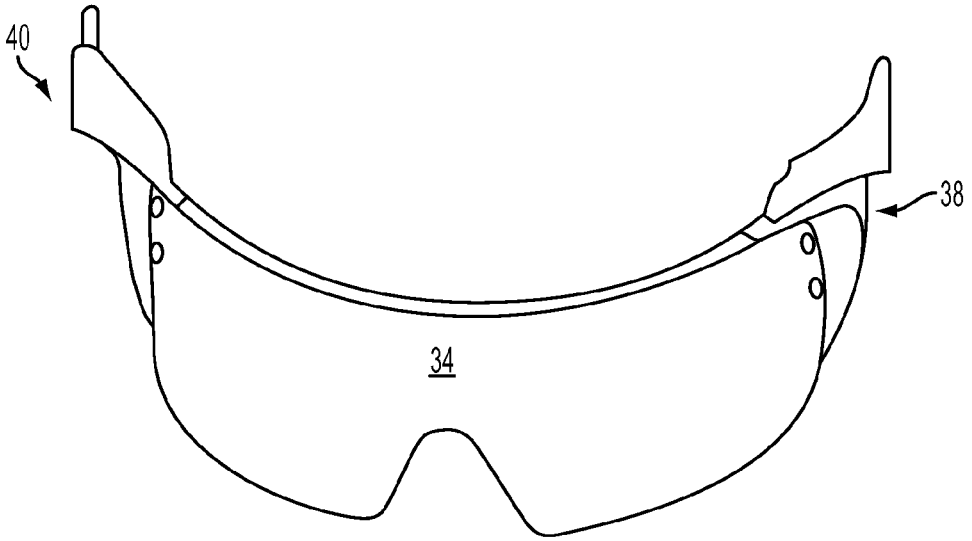
FIG. 11 is a front perspective view of the alternate visor system of FIG. 9 with a gasket removed.
Figure 12:
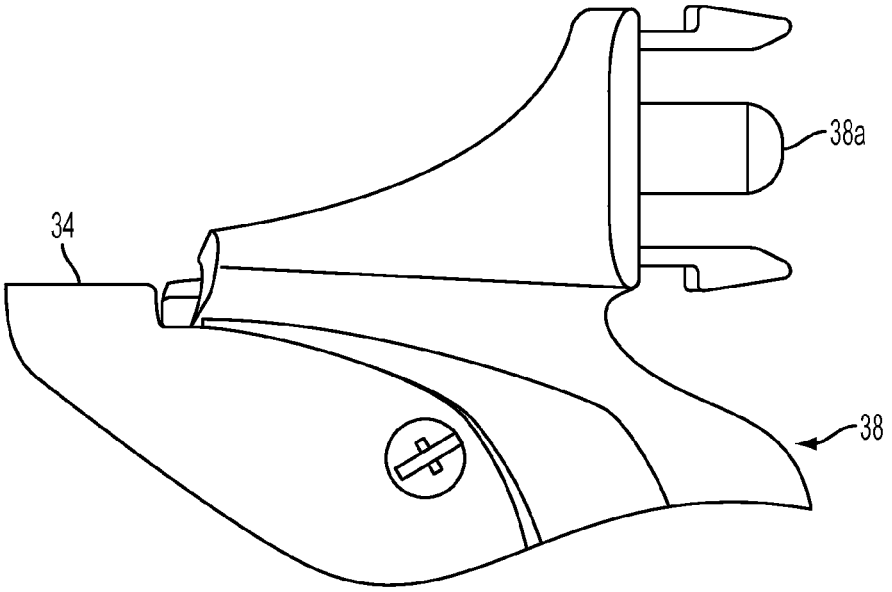
FIG. 12 is an enlarged, fragmentary perspective view taken from FIG. 11.
Figure 13:
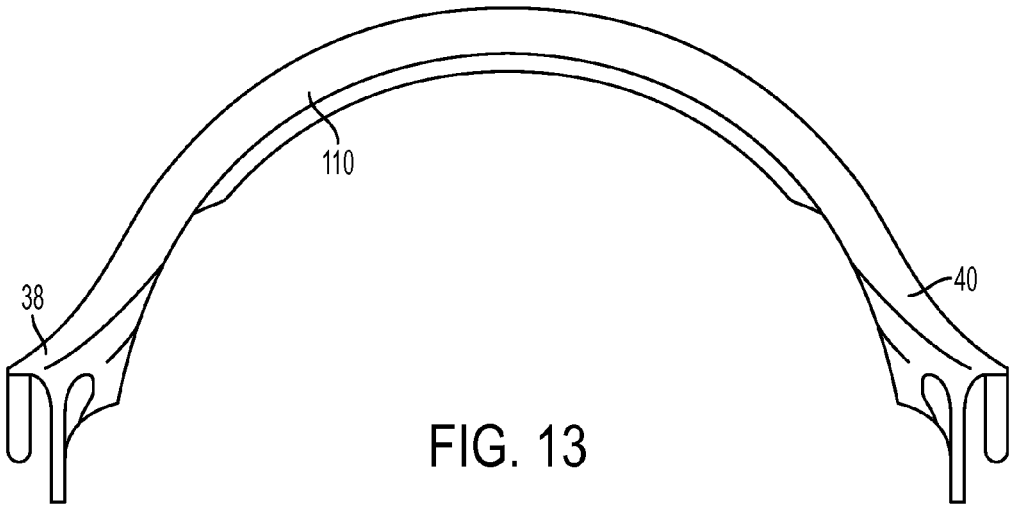
FIG. 13 is a top view of the alternate visor system of FIG. 9.
Figure 14:
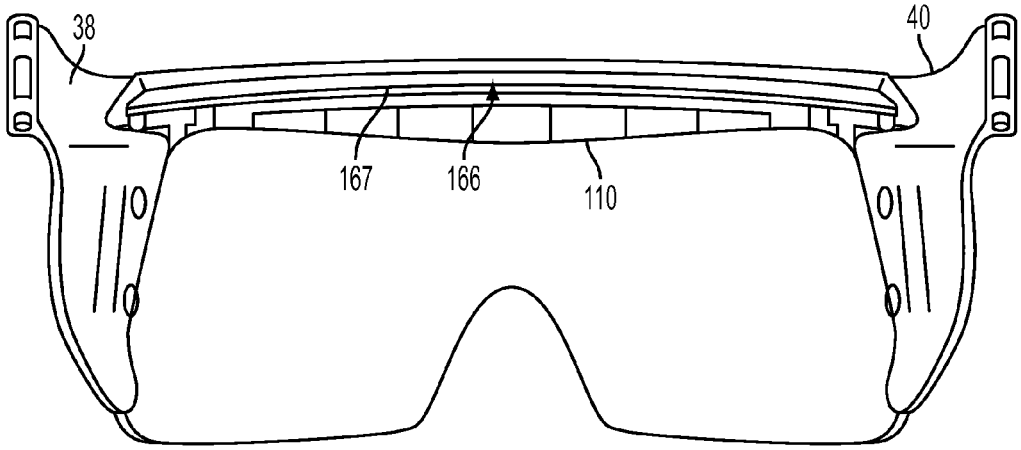
FIG. 14 is a rear view of the alternate visor system of FIG. 9.
Figure 15:
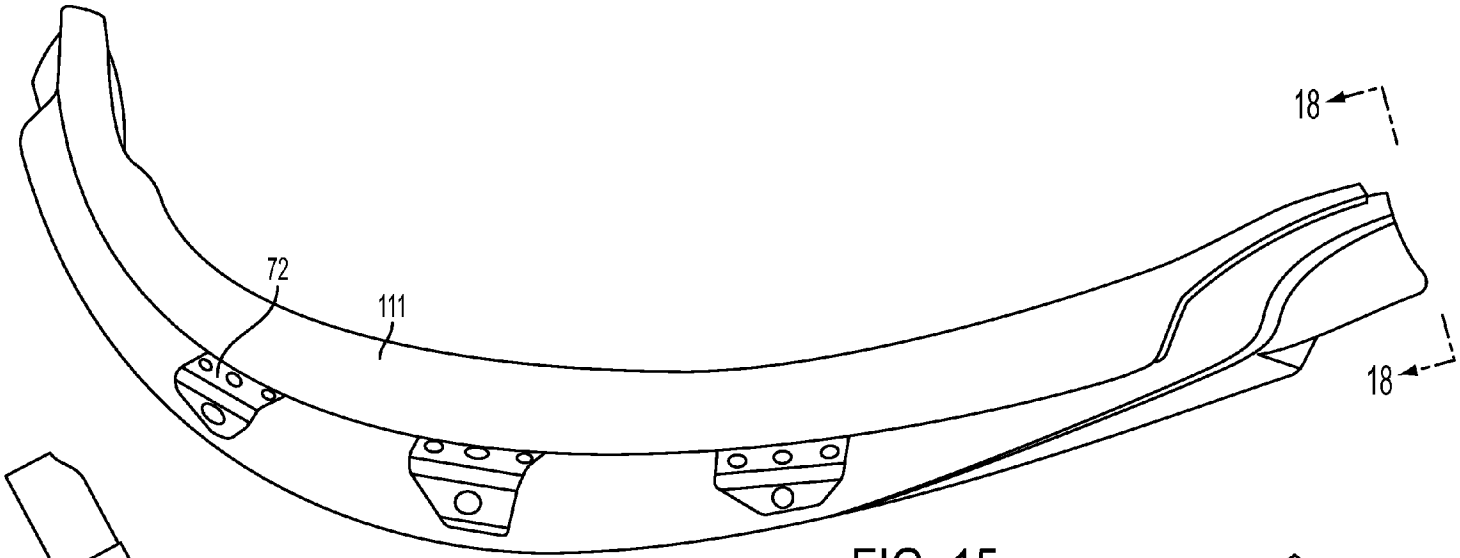
FIG. 15 is a translucent, perspective view of the gasket taken from FIG. 7.
Figure 16:
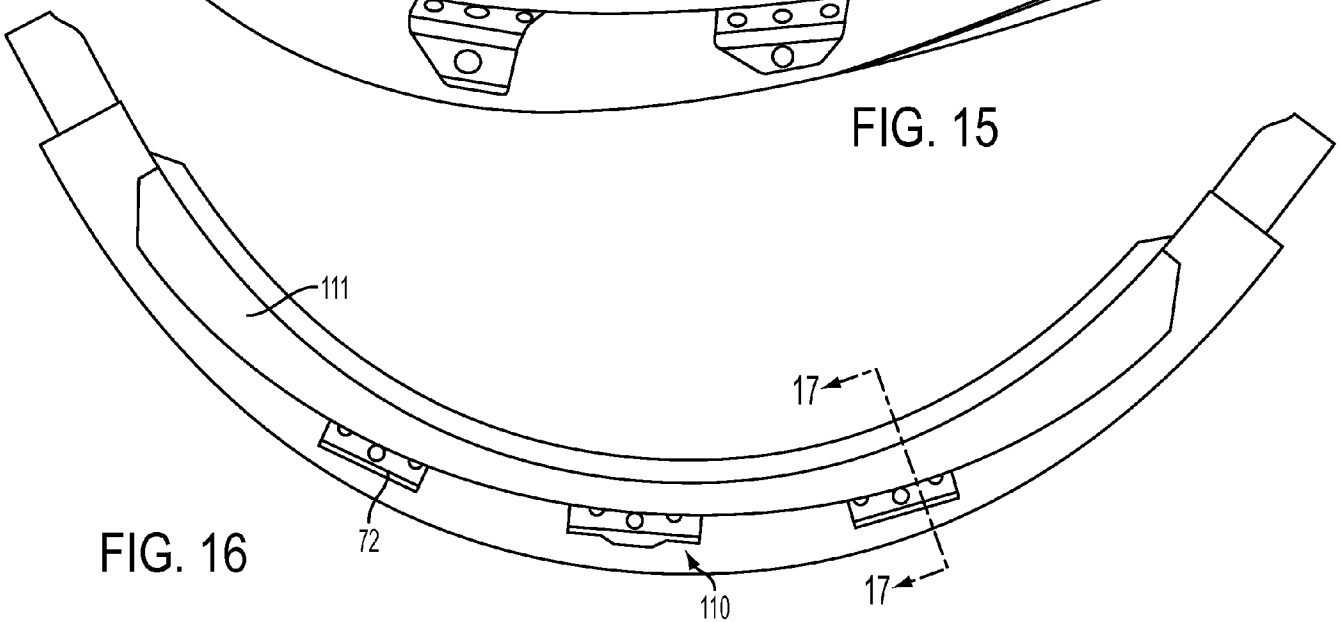
FIG. 16 is a translucent, top view of the gasket taken from FIG. 15.
Figure 17:
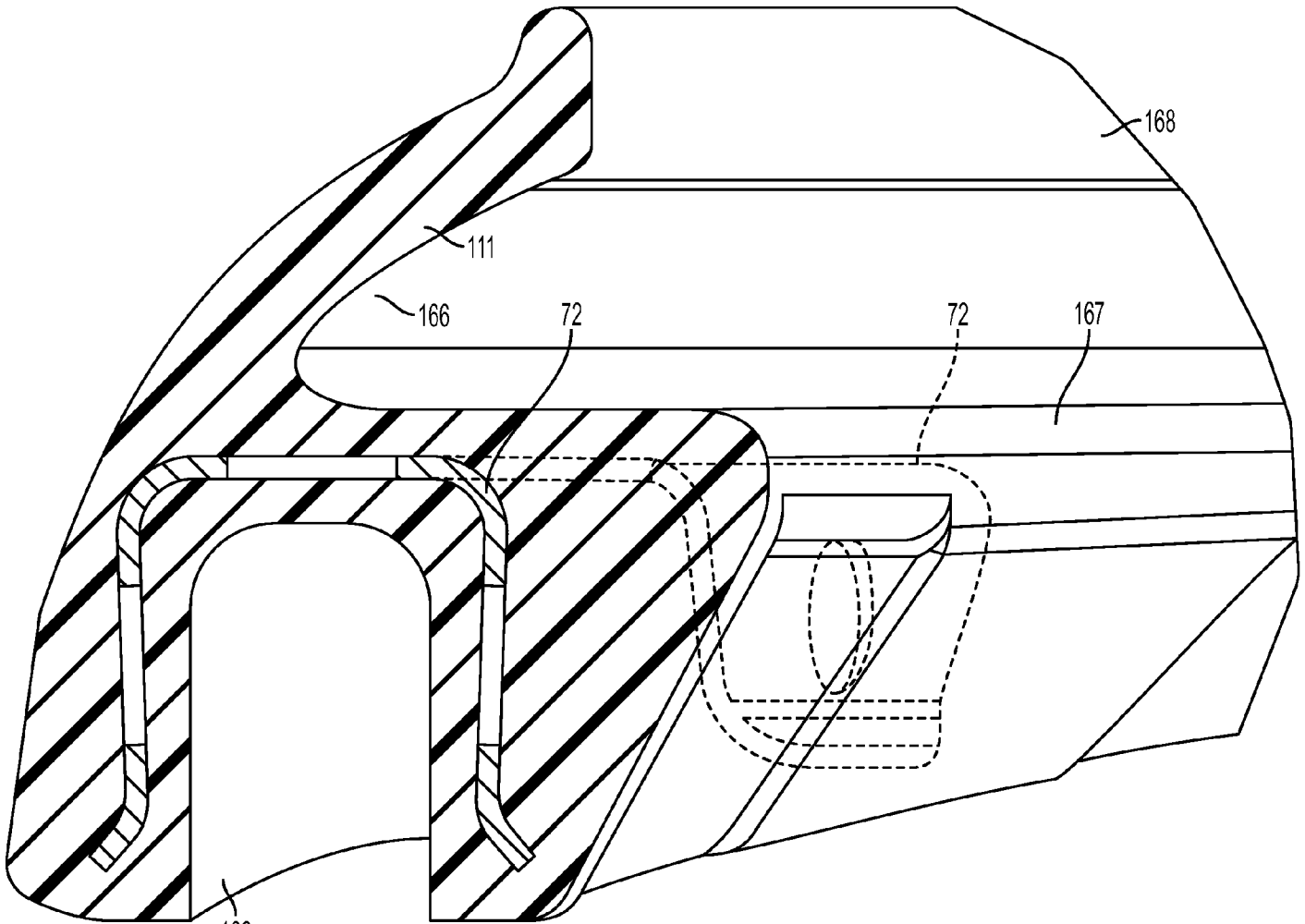
FIG. 17 is a sectional view taken generally along line 17-17 of FIG. 16.
Figure 18:
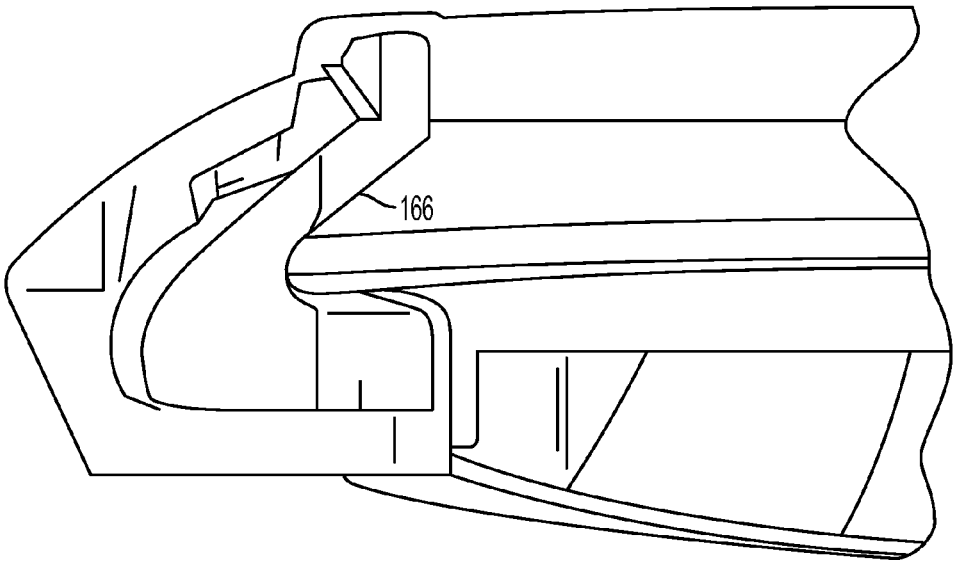
FIG. 18 is an enlarged, perspective view taken generally along line 18-18 of FIG. 15.
Figure 19:
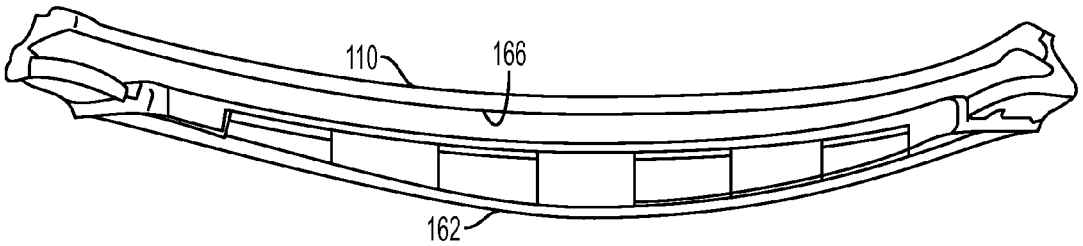
FIG. 19 is a rear view of the gasket of FIG. 16.
Figure 20:
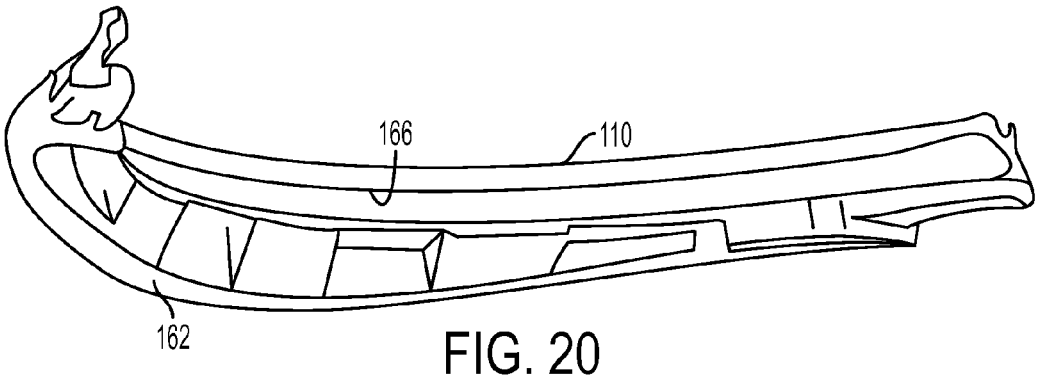
FIG. 20 is a bottom perspective view of the gasket of FIG. 19.

FIG. 1 illustrates a visor system 30 according to the present invention mounted to a military helmet 32. The visor system includes a face shield 34 connected to mounting end portions 38, 40. The mounting end portions 38, 40 include a male buckling attachment 38*a*, 40*a* that snap-engages into female sockets 42*a*, 44*a* of left and right accessory attachments 42, 44 respectively, that are mounted to the helmet 32 (see FIGS. 7 and 8). The attachments 42, 44 are preferably those of the multipurpose helmet attachment kit of the CFG Gallet® model CG634 helmet provided by Gallet Securite International Inc. of Quebec, Canada, and presently used by Canadian armed forces. These attachments allow for an upward pivoting of the visor away from the wearer's face when the visor is first pulled forwardly by the wearer against a spring force exerted by the attachments 42, 44 and then rotated upwardly and released by the wearer. Other types of visor attachments to the helmet are possible, including those described in U.S. Pat. Nos. 5,012,528; 5,966,738; 6,795,977; 5,396,661; 6,820,285; 5,329,642; 5,177,816; and 4,170,792, all herein incorporated by reference.

The visor system 30 further includes a top edge stop fixture 50. The top edge stop fixture 50 clips onto a top edge portion 52 of the face shield 34 and engages a front portion of a surrounding brim or lip 56 of the helmet 32. The stop fixture 50 spans a gap 57 between the top edge portion 52 and the helmet lip 56. The top edge fixture 50 includes a body 60 having a downwardly open slot 62 that is sized to resiliently grip a portion of the face shield adjacent the top edge, and an angled, tapered slot 66 that is sized and shaped to slightly press against upward and downward facing surfaces of the lip or brim 56 of the helmet 32.

When the face shield 34 is deployed by being pivoted downward and then moves inward toward the wearer's face by spring force of the attachments 42, 44, to be in front of the wearer's face, the tapered slot 66 is slightly pressed against the brim 56 of the helmet. The tapered slot 66 is formed by a horizontal leg 67 and an angled leg 68. The horizontal leg 67 abuts a downward facing surface 56*a* of the brim to prevent upward movement of the shield 34 with respect to the helmet, and the angled leg 68 presses against an angled, upward facing surface 56*b* of the brim 56 to prevent downward movement of the shield 34 with respect to the helmet in combination with the inward spring force exerted on the shield 34 by the attachments 42, 44.

Figure 5:
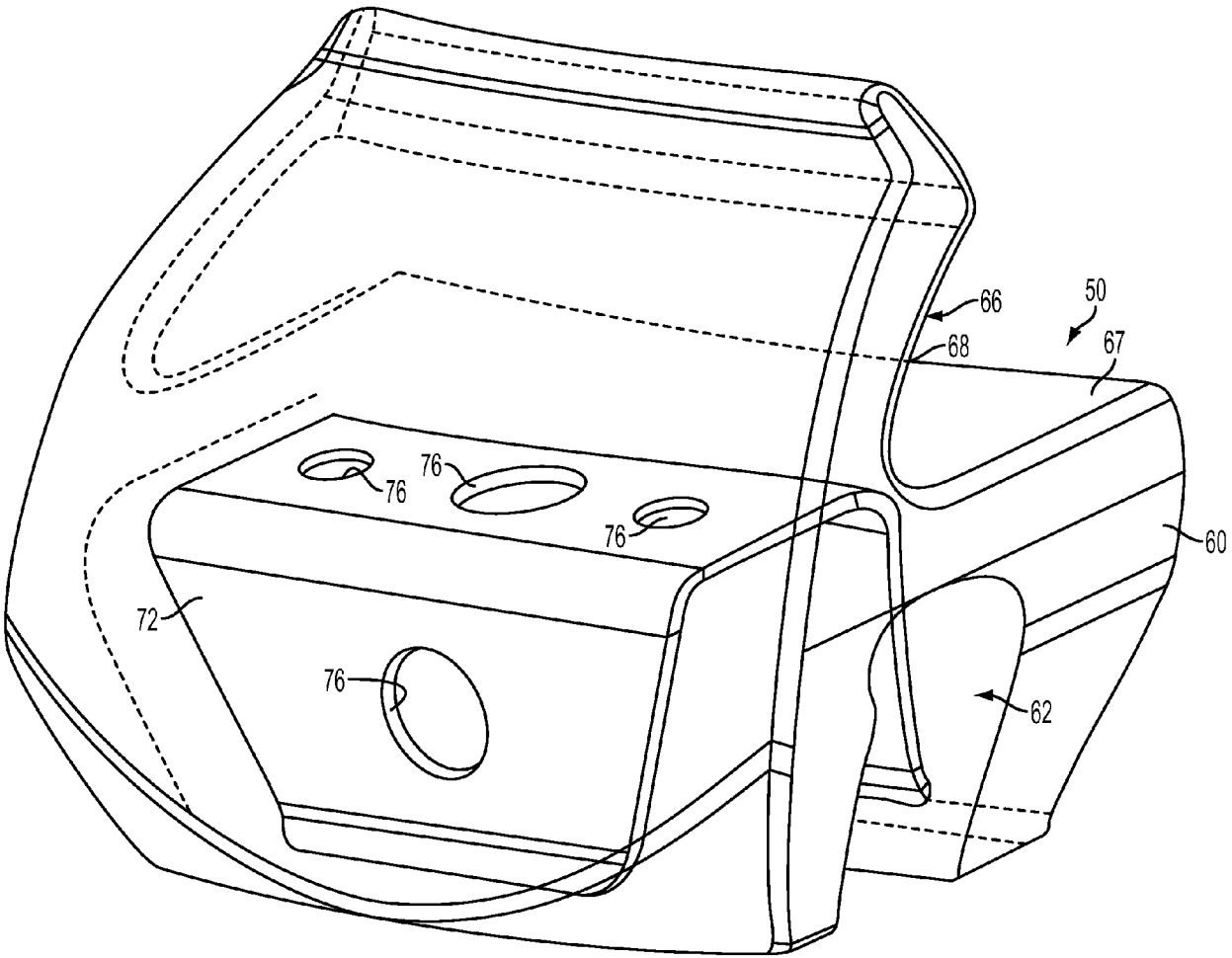
FIG. 5 is a translucent, perspective view of the visor stop taken from FIG. 1.
Figure 6:
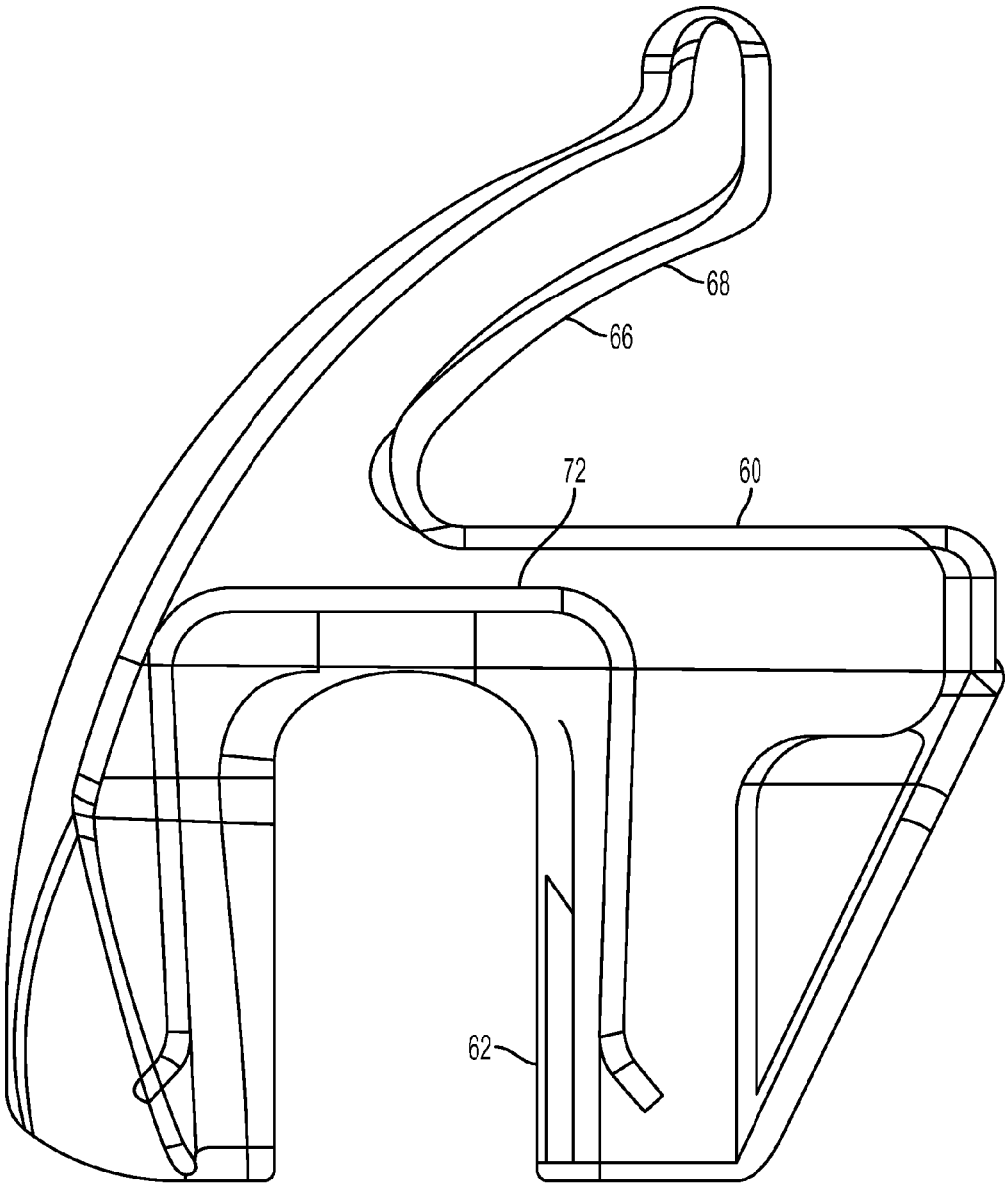
FIG. 6 is a translucent, side view of the visor stop taken from FIG. 5.

FIGS. 5 and 6 illustrate the fixture 50 more detail. A substantially inverted U-shaped resilient metal clip 72 is embedded in the body 60. During manufacture, the body 60 is molded over the clip 72. The clip 72 includes a plurality of holes 76 that function to integrate the clip structurally with the body 60 when the body 60 is molded over the clip 72. The clip 72 provides the resilient gripping force by the fixture 50 onto the edge portion 52 of the face shield 34.

Preferably, the clip 72 is composed of steel or other metal and the body 60 is composed of SANTOPRENE, a thermoplastic elastomer available from Advanced Elastomer Systems, LP, an ExxonMobil Chemical Affiliate in Akron, Ohio, USA.

Figure 21:
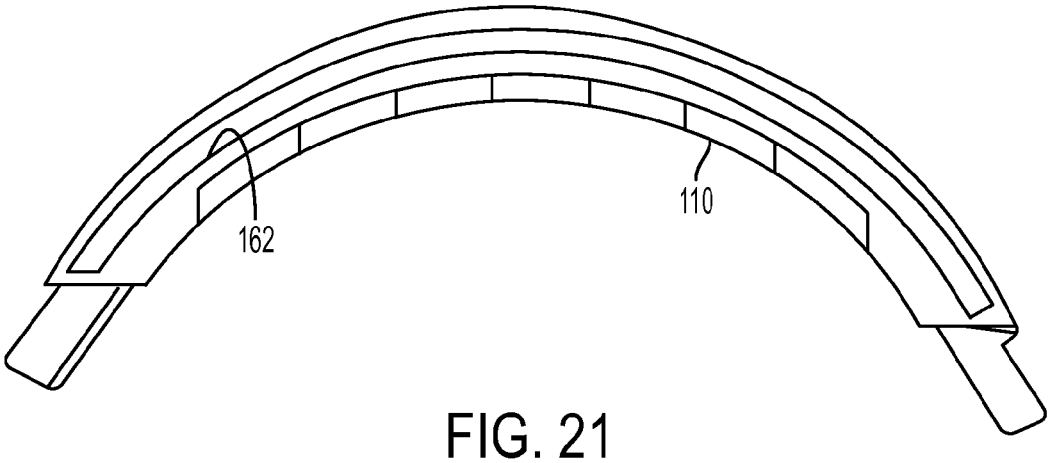
FIG. 21 is a bottom view of the gasket of FIG. 19.

FIGS. 7-21 illustrates an alternate embodiment system 100 that includes the same components as the initially described system 30 except that the localized fixture 50 is replaced by a gasket 110 that extends between end portions 38, 40. The gasket 110 comprises substantially the same cross-sectional shape as the previously described fixture 50, having a slot 162 for sealingly engaging the visor top edge portion 52 (FIG. 21) and a tapered slot 166 for sealingly engaging the helmet brim 56. The gasket 110 includes a gasket body 111 and can include a plurality of the previously described metallic clips 72 spaced along a length of the gasket 110. In the illustrated embodiment three clips 72 are used. During manufacture the gasket body 111 is molded over the clips 72.

The gasket 110 effectively closes the gap that otherwise exists between the top edge portion 52 of the face shield 34 and the brim 56 of the helmet. When the face shield 34 is deployed by being pivoted downward and then moves inward toward the wearer's face by spring force of the attachments 42, 44, to be in front of the wearer's face, the tapered slot 166 is slightly pressed against the brim 56 of the helmet. The tapered slot 166 is formed by a horizontal leg 167 and an angled leg 168. The horizontal leg 167 abuts the downward facing surface 56*a* of the brim to prevent upward movement of the shield 34 with respect to the helmet, and the angled leg 168 presses against the angled, upward facing surface 56*b* of the brim 56 to prevent downward movement of the shield 34 with respect to the helmet in combination with the inward spring force exerted on the shield 34 by the attachments 42, 44.

The gasket 110 effectively seals against the face shield 34 and the helmet 32 (FIG. 1). The gasket prevents liquid from entering this gap such as a flammable, poisonous, corrosive, or otherwise harmful liquid thrown by an adversary. The gasket also serves the shock absorbing and latching functions as described above with regard to the fixture 50.

Preferably the gasket body 111 is composed of SANTOPRENE.

Figure 22:
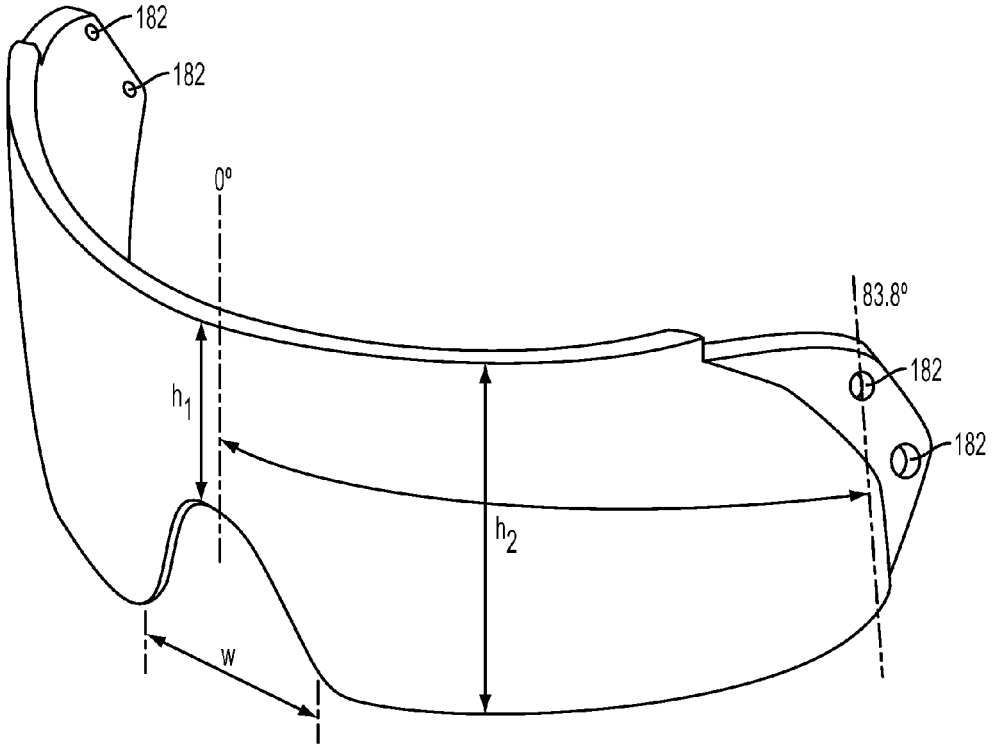
FIG. 22 is a perspective view of a visor face shield taken from FIG. 1.
Figure 23:
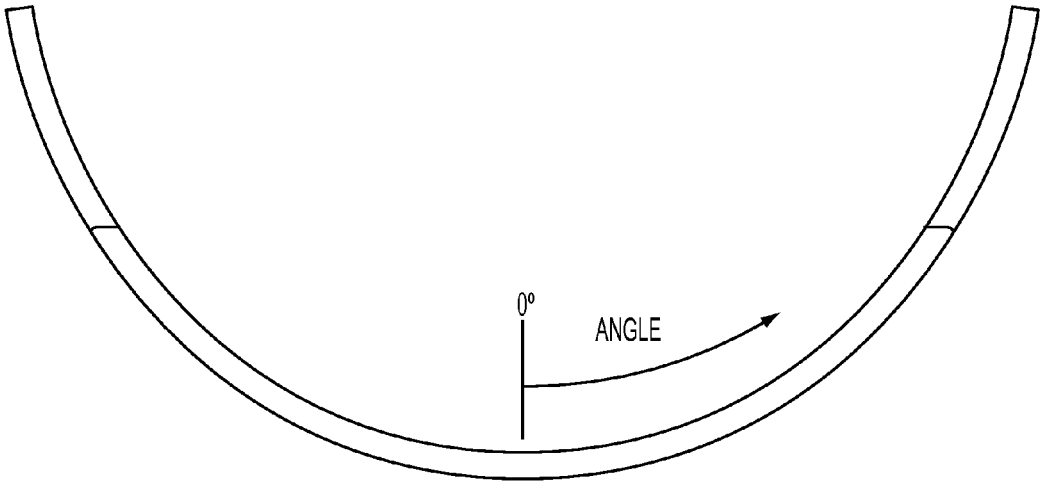
FIG. 23 is a top view of the face shield shown in FIG. 22.

FIGS. 22-23 illustrate the face shield or visor 34 of the invention. The face shield 34 includes mounting holes 182 for screw-mounting to the end portions 38, 40. According to one exemplary embodiment of the invention, for a medium size visor, the visor is injection molded having a shape that conforms to a curvature of an imaginary cylinder having a radius of 107 mm. The dimension h1 is 50 mm, the dimension h2 is 90 mm and the dimension w is 50 mm.

Figure 24:
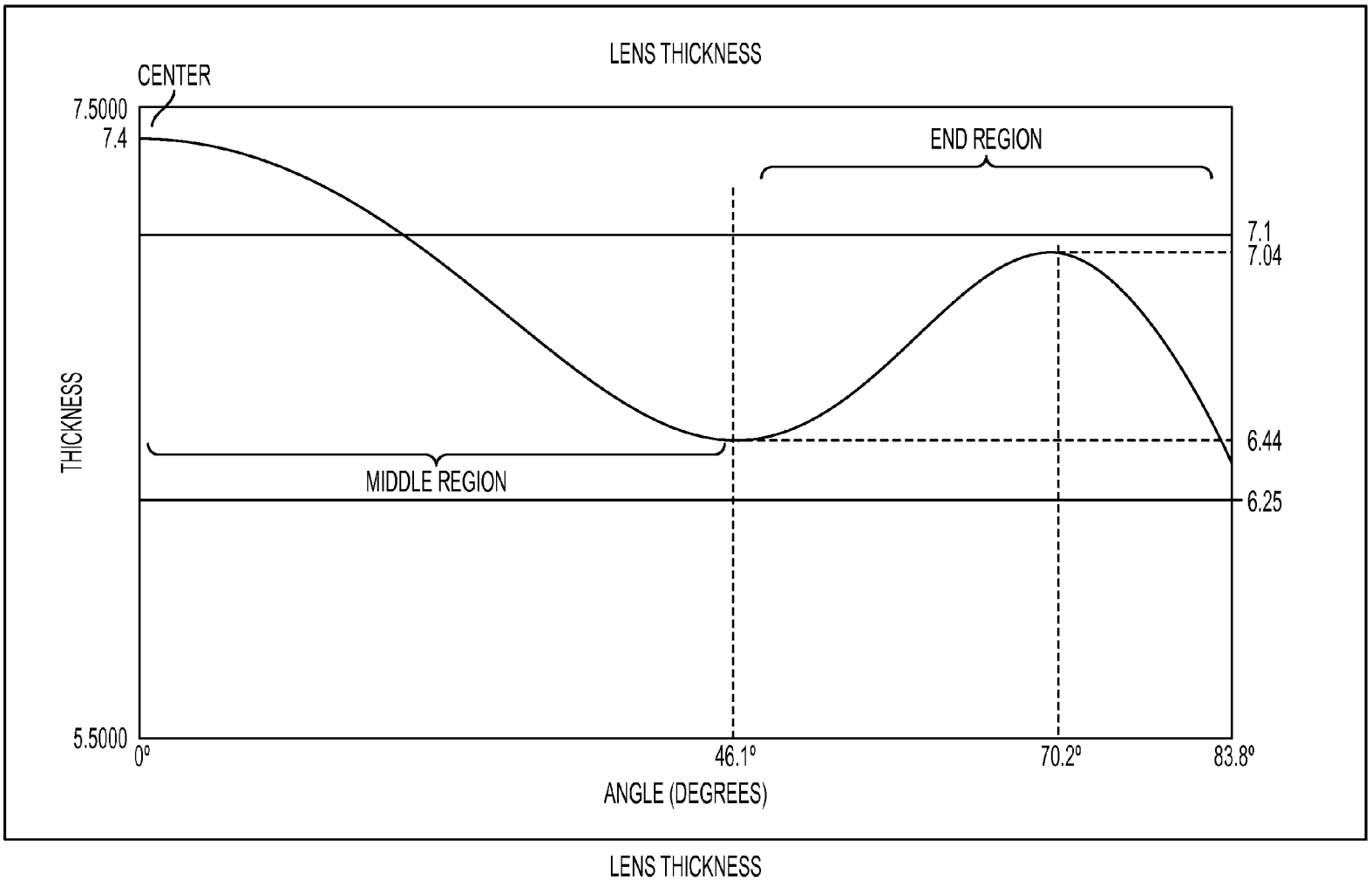
FIG. 24 is a thickness profile of the face shield shown in FIG. 22.

The visor 34 includes a varying thickness to correct for optical distortions aberrations. The particular thickness provides optical qualities that are compliant with ANSI Z87 standards. The visor includes a maximum thickness of approximately 7.4 mm and a minimum thickness of approximately 6.4 mm. A thickness measurement profile from a center to one lateral side, the opposite lateral side being mirror image identical, is shown in FIG. 24.

A viewing region of the face shield 34 extends, at eye level, from 0° (the center) out to approximately 83.8 degrees, to either side as shown in FIG. 22. Within this viewing region measured around the circumference of the cylindrically curved visor, the thickness sinusoidally tapers from a thick center of approximately 7.4 mm to approximately 6.44 mm at 46.1 degrees. The thickness sinusoidally increases from 6.44 mm at 46.1 degrees to a thickness of about 7.04 mm at 70.2 degrees. The thickness sinusoidally decreases from 7.04 mm at 70.2 degrees to a thickness of about 6.3 mm at 83.8 degrees. The visor remains thicker than 6.25 mm in all places for ballistic resistance.

The visor has a unique thickness profile that provides an improved optical quality to the visor despite the advantageous thickness of the visor for ballistic resistance. The thickness profile of the cylindrically curved visor, for each side, includes a thick center, sinusoidally decreasing middle region and a sinusoidally increasing then decreasing end region (FIG. 24).

Outside the viewing region is a structural region, functioning to attach the respective end portions 38, 40, wherein the opaque end portions block viewing.

The visor 34 is preferably composed of polycarbonate of a grade suitable for ballistic resistance.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A visor mounting apparatus for mounting a face shield to a helmet that has a brim, comprising:

a first rotatable receiver and a second rotatable receiver, each configured to be mounted to an outside of a helmet such that the first receiver is on an opposite side of the helmet as the second receiver;

a first end portion engageable with the first rotatable receiver and a second end portion engageable with the second rotatable receiver, the first and second end portions connecting ends of said shield to the first and second rotatable receivers;

a stop fixture comprising a mounting portion to removably attach the stop fixture to said shield, and an engagement portion having a first slot configured to engage a brim of said helmet to prevent vertical movement of said shield relative to a wearer when deployed in front of the wearer's eyes; and a gasket which is removably attachable to the shield, wherein removal of the stop fixture from the shield permits removable attachment of the gasket to the shield such that the stop fixture or the gasket can be selectively used with the shield, and wherein the gasket extends from the first end portion to the second end portion when the gasket is removably attached to the shield.

2. The apparatus according to claim 1, wherein said first slot is tapered.

3. The apparatus according to claim 1, wherein said mounting portion comprises a second slot configured to resiliently grip said shield through a thickness thereof.

4. The apparatus according to claim 3, wherein said first slot portion is tapered.

5. The apparatus according to claim 1, wherein said mounting portion comprises a polymer body and a metal spring element embedded in said polymer body.

6. A visor mounting apparatus for mounting a face shield to a helmet that has a brim, comprising:

rotatable receivers configured to be mounted to an outside of a helmet on opposite sides of the helmet;

end portions engagable with the rotatable receivers mounted to said helmet and connecting ends of said shield to the rotatable receivers; and a gasket mounted along a top edge of said shield, the gasket being shaped to create a sealing engagement with a brim of said helmet, wherein the gasket is positioned along at least an over eye portion of the top edge of said shield such that the gasket extends along and contacts a length of the top edge at least from over a first eye to over a second eye of a wearer when the shield is in a deployed position in front of the wearer's eyes, and wherein movement of said shield upwardly relative to the helmet causes the gasket to move upwardly relative to the helmet.

7. The apparatus according to claim 6, wherein the gasket includes a first slot that has a tapered cross-section.

8. The apparatus according to claim 6, wherein said gasket is configured to resiliently grip said shield across a thickness thereof.

9. The apparatus according to claim 6, wherein said gasket comprises a polymer body and at least one metal spring element embedded in said polymer body.

10. The apparatus according to claim 1, wherein the engagement portion comprises a horizontal leg and an angled leg where the first slot is formed between the horizontal leg and the angled leg.

11. The apparatus according to claim 1, wherein the mounting portion is configured to attach over a top edge of said shield.

12. The apparatus according to claim 1, wherein the mounting portion has an outside portion configured to cover a portion of the front surface of the shield, and an inside portion configured to cover a portion of the inside surface of the shield.

13. The apparatus according to claim 1, wherein the first and second rotatable receivers have a deployed position directing the shield over a user's eye, an extending position where the shield is positioned further forward from a user's eyes than when the first and second rotatable receivers are in the deployed position, and a standby position where the shield is located above the brim of the helmet.

14. The apparatus according to claim 6, wherein the rotatable receivers have a deployed position directing the shield over a user's eye, an extending position where the shield is positioned further forward from a user's eyes than when the rotatable receivers are in the deployed position, and a standby position where the shield is located above the brim of the helmet.

15. The apparatus according to claim 1, wherein the gasket seals against the shield and the helmet when the gasket is removably attached to the shield and engaged to the brim of the helmet.

16. The apparatus according to claim 1, wherein the stop fixture spans a gap between the shield and the helmet when the stop fixture is removably attached to the shield and engaged to the brim of the helmet.

17. A visor mounting apparatus for mounting a face shield to a helmet that has a brim, comprising:

a first rotatable receiver and a second rotatable receiver, each configured to be mounted to an outside of a helmet such that the first receiver is on an opposite side of the helmet as the second receiver;

a first end portion engageable with the first rotatable receiver and a second end portion engageable with the second rotatable receiver, the first and second end portions connecting ends of said shield to the first and second rotatable receivers; and a gasket mounted along a top edge of said shield, the gasket being shaped to create a sealing engagement with a brim of said helmet, wherein the gasket extends from the first end portion to the second end portion, and wherein movement of said shield upwardly relative to the helmet causes the gasket to move upwardly relative to the helmet.

18. The apparatus according to claim 17, wherein the gasket includes a first slot along said gasket that is shaped to create a sealing engagement with a brim of said helmet.

19. The apparatus according to claim 17, further comprising:

a stop fixture comprising a mounting portion to removably attach the stop fixture to said shield, and an engagement portion having a first slot configured to engage a brim of said helmet to prevent vertical movement of said shield relative to a wearer when deployed in front of the wearer's eyes, wherein:

the gasket is removably attachable to the shield, and removal of the gasket from the shield permits removable attachment of the stop fixture to the shield such that the stop fixture or the gasket can be selectively used with the shield.

20. The apparatus according to claim 6, wherein movement of said shield upwardly relative to the helmet causes the gasket to move upwardly relative to the helmet.

* * * * *